United States Patent [19]

Ross et al.

[11] 4,022,232

[45] May 10, 1977

[54] INVERTED CARGO HATCH TENT

[75] Inventors: David G. Ross, Los Alamitos; Jack Wybenga, West Covina, both of Calif.

[73] Assignee: Retla Steamship Company, Long Beach, Calif.

[22] Filed: Jan. 26, 1976

[21] Appl. No.: 652,254

[52] U.S. Cl. ..... 135/6; 4/172.12; 114/203; 214/15 A

[51] Int. Cl.[2] ..... B63B 19/14

[58] Field of Search ..... 135/6; 114/201 R, 203; 220/18; 214/15 A; 61/.5; 4/172.12, 172.14

[56] References Cited

UNITED STATES PATENTS

| | | | |
|---|---|---|---|
| 2,849,010 | 8/1958 | Marino | 135/6 |
| 3,373,464 | 3/1968 | Ausuit | 4/172.12 X |
| 3,405,814 | 10/1968 | Yanow | 135/6 |
| 3,834,340 | 9/1974 | Thorpe | 114/201 R |
| 3,982,286 | 9/1976 | Foster | 4/172.14 |

FOREIGN PATENTS OR APPLICATIONS

| | | | |
|---|---|---|---|
| 721,966 | 1/1955 | United Kingdom | 135/6 |

*Primary Examiner*—Werner H. Schroeder
*Assistant Examiner*—Conrad L. Berman
*Attorney, Agent, or Firm*—David H. Semmes

[57] ABSTRACT

For protecting cargo in a ship's hold an inverted hatch tent is mounted between a cargo hatch cover and the hatch coaming to thereby define a concave liner below the hatch cover. The inverted hatch tent accoding to the instant invention therefore protects cargo from inevitable water leakage even with the hatch cover in place. Th instant liner further accommodates various hatch opening sizes through a plurality of gripper lines on the underside of a single liner. A further advantageous feature on the instant invention is the provision of a drain line at the apex of the inverted cover to communicate with a drain line which is passed within the hatch along the side wall and down to the ship's bilge.

13 Claims; 5 Drawing Figures

INVERTED CARGO HATCH TENT

BACKGROUND OF THE INVENTION

1. Field of the Invention

The present invention relates to a structure which is to be mounted between a cargo hatch and its coaming in order to define a concave liner which will collect any water seepage below a hatch and thereby protect the cargo while at sea or dockside.

The instant invention is converned with hatch covers for cargo ships, including various hatches as are presently found on various size ship holds.

Because of the universal geometry of the instant design, the hatch cover will be adaptable to various and sundry hatches sizes without alteration and thereby provides a particularly economical and efficient manner of insuring that any water seepage from below a hatch cover into a ship's hold will be effectively drained to a lower bilge position without contact and resultant damage to the cargo held therewithin.

2. Description of the Prior Art

The prior art as known to applicant in the field of structures to prevent water damage to cargo within a ship's hold represents a universal reliance upon external tarpaulin covers outside of the hatch cover or convex hatch tents which must be assembled over an open hatch cover during dockside loading operation.

Exemplary of this prior art are the following:

| | |
|---|---|
| GREAT BRITAIN | 827,045 |
| GREAT BRITAIN | 287,343 |
| FRANCE | 1,140,453 |
| GERMANY | 1,125,306 |
| YANOW | 3,405,814 |
| BARTOLUCCI | 3,148,384 |
| LANDIS | 3,037,251 |
| VON TELL | 1,319,980 |
| NORLING | 1,319,610 |
| McDOUGALL | 1,270,428 |
| SCHULHOFF | 1,093,211 |

Great Britian 827,045 illustrates a clamp for conventionally securing a tarpaulin over a hatch cover and against the coaming of the hatch. As such this patent simply represents one variant on securing a batten externally for holding a tarpaulin outside a hatch cover.

The tent design of British 287,343 illustrates a known convex awning structure with further provision for hoisting line access during loading and unloading operations. Similarly, the weatherproof convex cover of French patent 1,140,453 also provides for access of a hoist line during operations and does not contemplate a seaworthy rain protection structure for a closed hatch.

German patent 1,125,306 illustrates another form of hatch tent usuable only for loading operation and not an inverted hatch tent which is suspended below a secured hatch cover with provision for draining accumulated water into a bilge.

The U.S. patent to Yanow similarly is only usable as a temporary hatch tent while cargo is being unloaded or loaded. At FIG. 10 Yanow illustrates a rain catch 57 to allow water from the temporary door 29*c* to drain off through line 58, however, the temporary tent of Yanow has no applicability whatsoever as a seal between a closed hatch cover and the hold coaming.

The swimming pool cover of Bartolucci illustrates a non-analogous type of cover for a rectangularly open structure with his disclosed improvement being in the particular fastening means. The use of a cover over an opening per se is, of course, well known. However the specific cover structure herein interacts between a hatch coaming and a hatch cover by particularized gripping means to define a total drainage system in order to constitute a significantly improved structure that solves what was heretofore a very vexing problem in this art.

The patent to Landis illustrates a type of sealing gasket having particular utility for a closable door and does not contemplate an inverted tent structure extending downwardly from the four sides of a hatch for accumulation and drainage of water leakage.

The tarpaulin and batten structures of Von Tell and Norling are enclosed merely to represent other conventional tarpaulin securing arrangements wherein a batten secures a tarpaulin over the hatch cover and outside the hatch coaming.

The early patent to McDougall teaches a sealing structure between a hatch cover 6 and a coaming 3 wherein water tightness is maintained through packings between the cover and the coaming. There again is no inverted tent formed between the hatch cover and the coaming to allow the inevitable water seepage to be kept from the cargo.

Finally, the patent to Schulhoff is cited to show a non-analogous rubber stopper for covering a horizontal milk bottle opening with one type of gripper assembly engaging a vertical flange about the opening. As such this milk bottle stopper is pertinent only to show one type of gripper design which cooperates to hold a cover over a horizontal opening.

In summary, none of these references begin to teach an inverted tent for suspension between a hatch cover and its coaming. Furthermore, the further provision of a congruent series of gripper lines to accommodate various coaming sizes and/or drain line from the lowest point of the suspended cover is not contemplated by the clear teachings of these references.

BRIEF DESCRIPTION OF THE INVENTION

The present invention teaches a structure which allows a positive manner of preventing water leakage from below a hatch cover from despoiling cargo held within the hatch. The specific structure comprises an inverted hatch tent which is particularly advantageous for the purpose of preventing water damage to cargo within a ship's hold through a novel cooperation of structure.

The inverted hatch tent taught herein basically comprises a reversed umbrella that is adapted to hang immediately under a hatch cover to define a concave structure immediately below the cover. At the apex of the concave structure, the instant invention further includes a drain which cooperates with a tube hung therebelow for drainage of collected water from the apex of the inverted hatch tent down along the sidewall of the hatch and into the bilge located in the bottom of every cargo hatch. According to a preferred embodiment, the liner material is vinyl coated nylon which may be of 18 ounce strength with the overall configuration made up of four triangular pieces to define a cover which will have a projection on a horizontal plane in the shape of a rectangle.

According to this preferred embodiment, the four triangular quadrant elements define the overall rectangular configuration with a reinforced drain and lifting strap structure at the apex. Because hatch covers on merchant marine vessels are not standardized but range from, for example, a rectangular coaming dimension of 30 × 40 feet to a rectangular coaming dimension of 60 × 85 feet, the instant inventive structure provides for a series of gripper lines on the underside of the inverted hatch tent so as to make a single structure adaptable to the various and sundry cargo hatch coaming dimensions.

A particularly advantageous feature of this structure is a series of grippers mounted at spaced positions along the gripper lines which equal conventionally sized cargo coamings, with the grippers so configured to cooperate with conventional hatch cover gaskets as they intersect lips on cargo hatch coamings so that the inverted hatch configuration will be maintained according to the principles of the instant invention without regard to the size of the cargo hatch upon which the structure is employed. The gripper assembly is advantageously configured so that positioning of a hatch cover with its gasket over the associated coaming and its mounting lips is not interfered with by the addition of the present inverted hatch tent structure.

Therefore, it is an object of the present invention to provide a hatch liner which may be conveniently used on various and sundry cargo hatches both with a hatch in position during a sea voyage, or during dockside periods with the hatch cover either in place or removed.

It is a further object of the invention to provide a hatch cover which may be easily lifted and removed immediately prior to off loading operations by conventional ship rigging.

It is a further object of this invention to provide for a hatch liner which absolutely prevents water seepage through a closed hatch cover and drainage of water seepage down along the inner wall of the hatch into a bilge without contacting and damaging the cargo. It is a further object of this invention to provide for a particularly efficient manner of protecting the cargo by a structure which need not be stowed during shipping procedures when the hatch cover is in place and yet may be quickly removed for loading operations through an efficient interconnection of ships rigging with selected portions of the inverted hatch tent structure thus allowing removal without trained personnel or critical adjustment.

It is yet a further object of the instant invention to provide for an inverted hatch tent which is effective for all commonly found hatch coaming sizes without loss of effectiveness for its intended purpose when used with any sized cargo hatch.

Further objects and features of advantage will become apparent with reference to the following description of a preferred embodiment as illustrated in the drawings.

DESCRIPTION OF THE PREFERRED EMBODIMENTS

Figure 1:
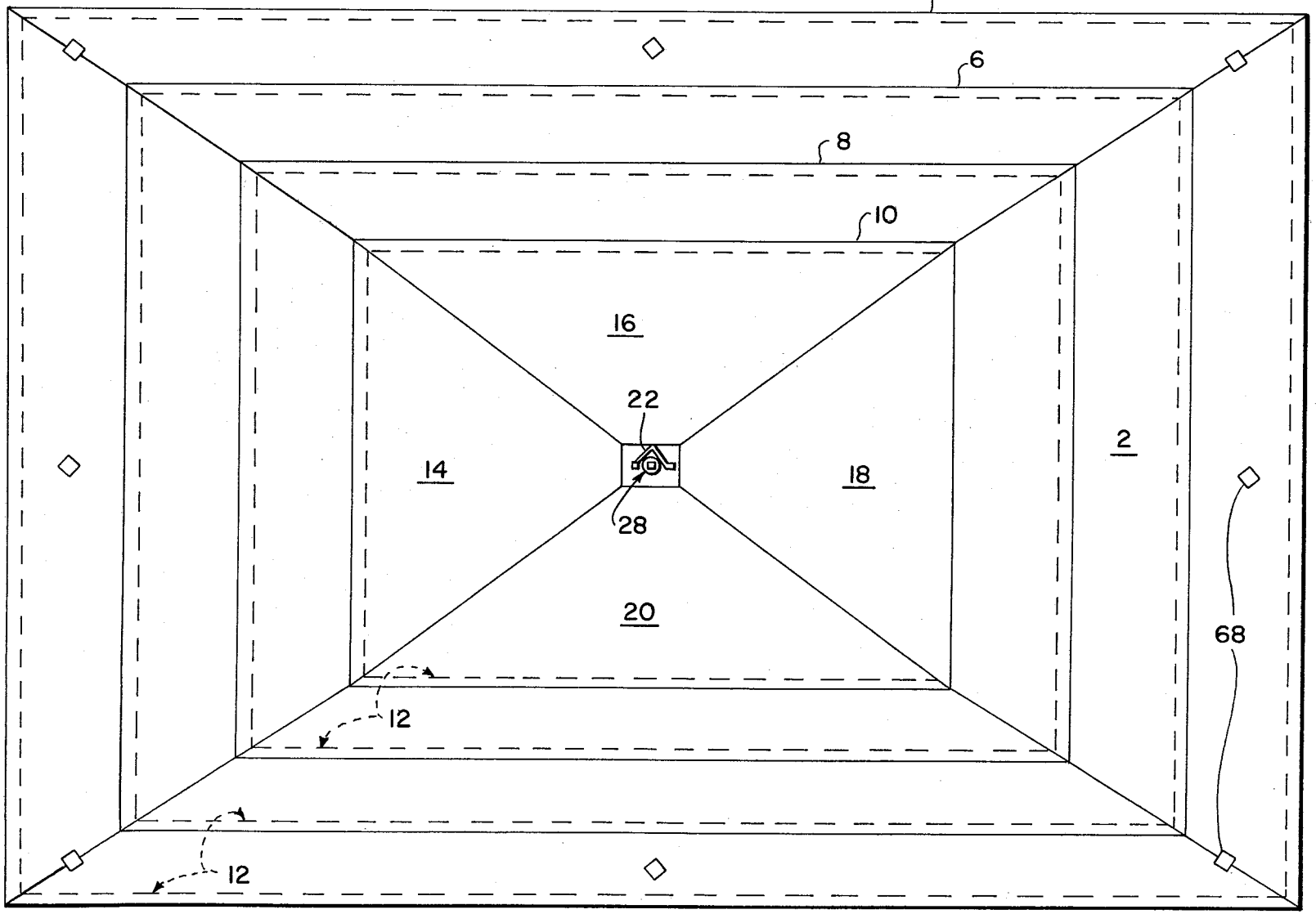
FIG. 1 is a top view of an inverted hatch tent by the instant invention.

The present invention contemplates the combination of inverted hatch tents operatively engaged between a hatch cover and the associated coaming on a cargo hatch. Referring to the drawings for further detail of the preferred embodiment according to this concept as taught herein, FIG. 1 is a top or plan view of a liner generally designated 2. According to this preferred embodiment the inverted hatch tent liner may be further comprised of four triangular quadrants labeled for reference purposes as first quadrant 14, second quadrant 16, third quadrant 18 and fourth quadrant 20. These quadrants may be sewn or otherwise bonded to further define the overall configuration which is a convex pyramidal structure when viewed from above and employed according to its intended function.

The cargo hatch cover 2 as illustrated at FIG. 1 has an outer edge 4 which, according to the conventional hatch design, may be substantially rectangular with dimensions on the order of sixty feet by eighty-five feet. Congruently inward from this first rectangular outer dimension is a second dimension which is generally designated as 6 and will be referred to as a first inner dimension which, for example, may be a rectangular reference of a dimension of fifty feet by seventy feet. Similarly, a minimum inner dimension for a small cargo hatch is shown with dimensions on the order of thirty feet by forty feet to define a third inner dimension as shown in FIG. 1 at 10.

As will be hereinafter described, the respective dimensions 4, 6, 8, 10 may include, relatively inward therefrom, respective gripper mounting lines which may be on the order of eight inches inward from each of these respective dimensions corresponding to normally encountered cargo hatch sizes. These respective gripper mounting lines 12 refer to preferred positions for a series of single cavity molded grippers which are configured to cooperate in a particularly efficient manner with a hatch cover and a coaming lip, as will be hereinafter more particularly described.

The overall inverted hatch tent structure according to this invention further includes a lifting strap 22 at the apex of the convex overall configuration with this lifting strap 22 being mounted as at 24 to a reinforcing panel 26. The apex reinforcing panel 26 further includes at the geometrical center a drain shown at 28 which would be preferably of a minimum diameter of 6 inches with an associated grating if desired.

Figure 2:
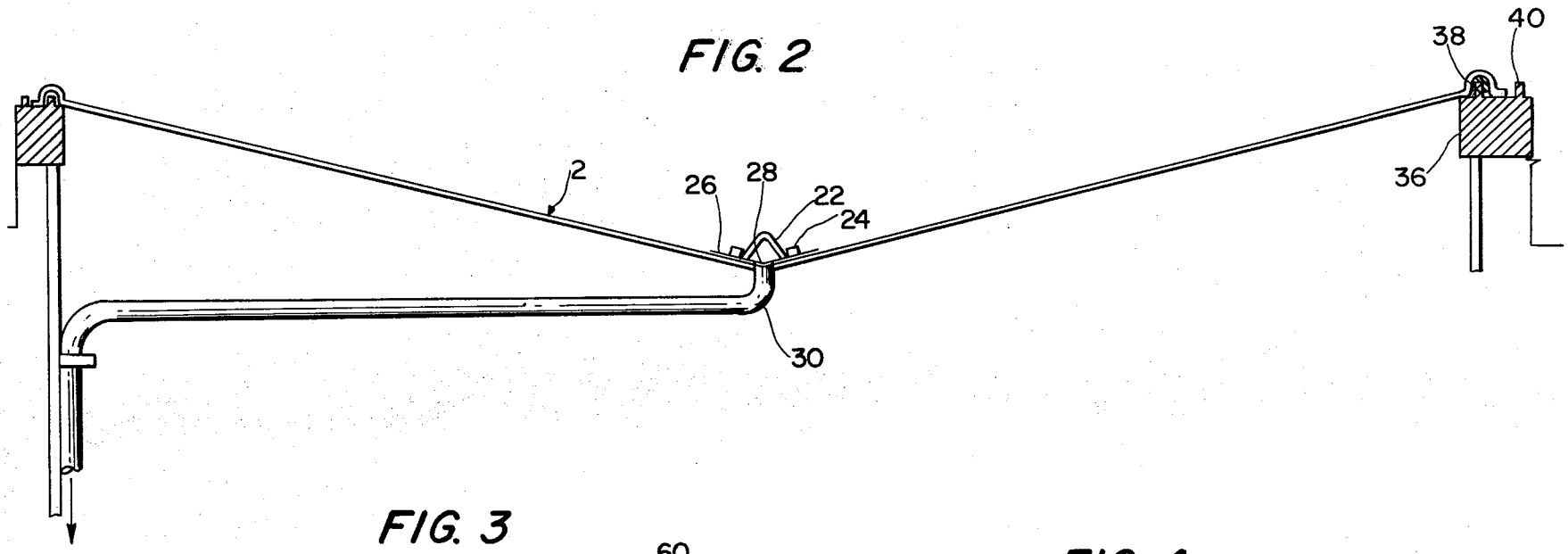
FIG. 2 is a conventional side view schematically illustrating a preferred embodiment of the instant invention.

With respect to FIG. 2 which shows the inverted hatch tent according to this invention in sectional side view, the drain 28 has at its underside an open connection with a drain line 30 which is flexibly routed to the inner hatch wall 32 and may be fixed thereagainst by any securing means such as shown at 34. According to the concept of the instant invention, this flexible drain line 30 allows any water which has seeped within the hatch cover to be effectively drained from the apex of the inverted hatch tent around the cover and down into the bilge located in the bottom of any ship cargo hatch.

With further reference to FIG. 2 it can be seen that the inverted hatch tent is supported upon a typical hatch coaming 36 which conventionally includes an inner coaming lip 38 and an outer coaming lip 40. The detail of a conventional coaming lip and hatch cover design is further shown in FIG. 5 where a representative hatch cover 42 which includes a hatch gasket 44 is positioned over the coaming 36 with the gasket 44 providing for resilient sealing engagement around the exemplary coaming lips 38 and 40.

Figure 4:
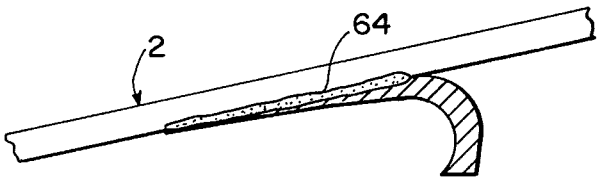
FIG. 4 schematically illustrates a single gripper assembly and its attachment to the hatch liner in a preferred embodiment.
Figure 5:
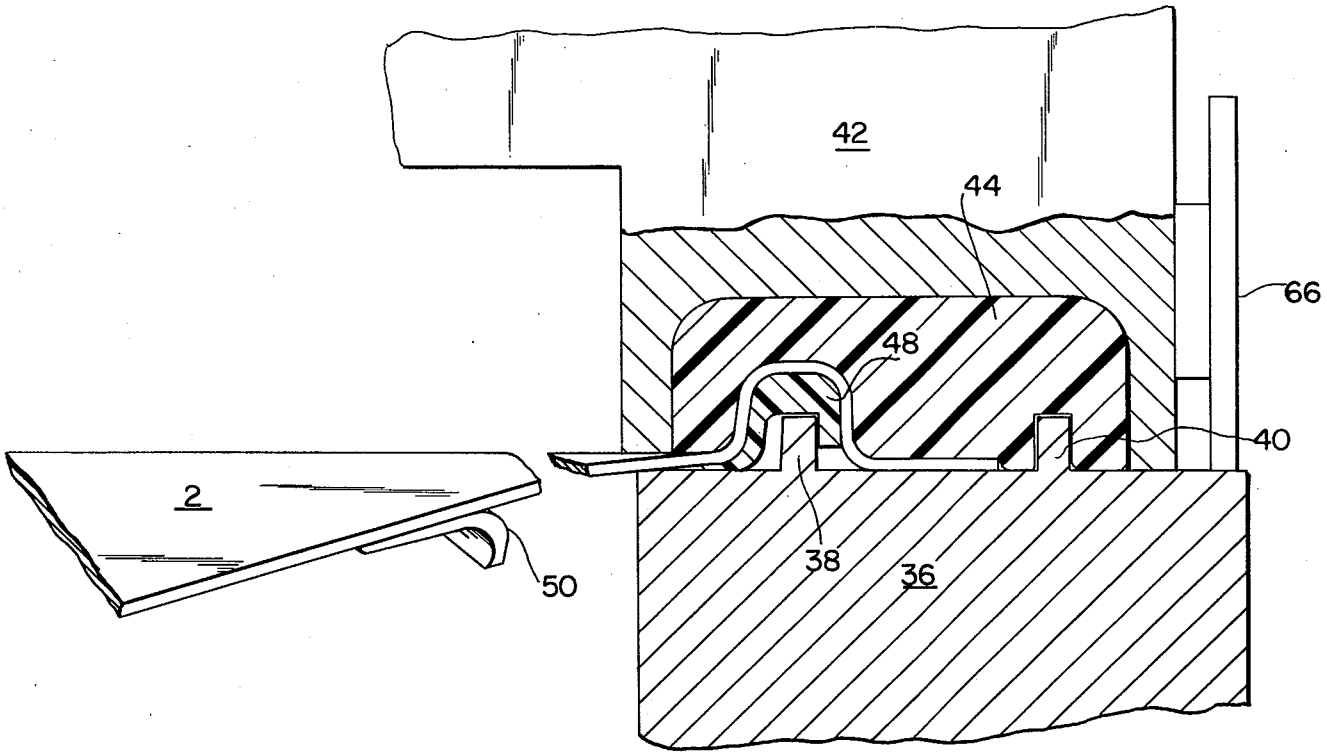
FIG. 5 is a schematic detailed illustration of the mounting of the instant invention in its intended operation.

With reference to FIG. 5, the interaction of the gripping assembly upon and with the hatch cover and the coaming will now be further detailed. As shown in FIG. 5 a representative single cavity molded gripper 48 is bonded to the underside of the inverted hatch tent. The manner of securing this molded gripper to the underside of the inverted hatch tent is perhaps more clearly illustrated in FIG. 4 where the liner material 2 includes on its underside a bond 64 between the underside of the liner and the top inclined edge of the molded gripper. It should be noted that for a representative hatch liner as taught herein, and illustrated with respect to FIG. 1, the typical single cavity molded grippers would be mounted on the respective lines 12 and spaced therealong to define a continuous rectangular gripping line arrangement. For example, for the hatch cover according to the preferred embodiment, which has an outer rectangular configuration measuring sixty feet by eighty-five feet, there would be approximately 430 grippers required along the respective gripper lines 12. This number of individual grippers bonded to the underside assumes a width for each gripper on the order of two inches with each gripper being spaced approximately twenty-four inches on center. Of course, any other basing or length of individual grippers would accomplish the teaching according to the present invention, and it has been found that this distribution of grippers along the respective gripper lines 12 allows for the liner to engage the respective coaming lips for any sized hatch, as is conventionally found in the industry. As will now be explained, these representative individual grippers cooperate in a unique fashion within the entire structure due to their mounting position and relation to the liner and the hatch coaming with or without the hatch cover.

Figure 3:
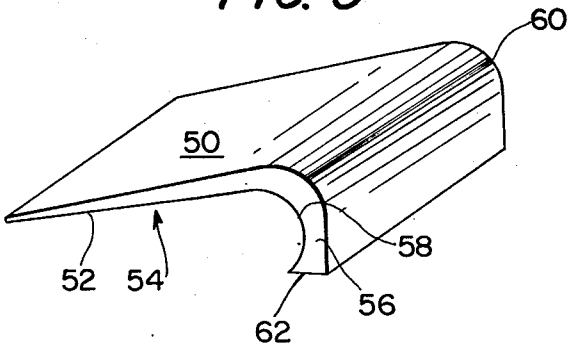
FIG. 3 is a detailed view of a gripper assembly according to a preferred embodiment.

As shown in FIG. 3, a representative single cavity molded gripper 50 includes a tapered flange surface 52 which advantageously allows for a relatively gradual thickness change in the overall liner from and along the points of its bonding to the underside of the liner. The cavity defining the gripper essentially includes surfaces 54, 58 and an outer leg 56, the whole being integrally formed of an elastomeric material. The outer leg 56 includes an inner gripper contour 58 in the form of a circular section as shown in FIG. 3 with the continuation of surfaces 54 and 56 ending at the flat distal end 62 thereby defining a gripper cavity which advantageously interacts with the coaming lip 38, as is best illustrated in FIG. 5.

In FIG. 5, an exemplary gripper 48 is shown in its deformed mounting position upon an inner coaming lip 38 proximate the inner wall of the cargo hatch. As has been discussed, cargo hatch cover 42 conventionally includes a gasket 44 of a elastomeric material which is configured to resiliently engage against the coaming and the coaming lips to define a form of seal for the hatch cover and coaming assembly.

FIG. 5 has a schematic representation of a right edge of the inverted hatch tent 2 together with another exemplary gripper 50 which, as has been discussed, is positioned along one of the inward gripping lines to correspond to respective inner dimensions for allowing a single liner to function with any number of conventional cargo hatch opening sizes. The deformed gripping member 48 is shown in FIG. 5 to be mounted upon the inner coaming lip 38 with the deformed gripper resiliently urged against both sides of the coaming lip 38. The resilient hatch cover gasket 44 is resultantly deformed to conform to the outer surface of the liner material thereby compressing the assembly of the gripper assembly 48 on the underside of the liner tightly against the coaming lip 38. The outer leg 56 is further shown to cooperate with the undersurface 54 to define a gripper cavity which is urged against the coaming lip 38 under the compressive action of the gasket 44. It should be noted at this point that in FIG. 2 is shown a gripper assembly similarly mounted upon an inner coaming lip 38 and secured thereupon without necessity of the further compressive action of the hatch cover 44. As shown in FIG. 2, the instant invention is then equally applicable for preventing rain damage to cargo within a hold when the hatch cover is not in place. Because of the circular inner gripper contour 58, as illustrated in FIG. 3, the gripper assembly will be able to slightly pivot upon the distal end of the coaming lip 38 during lowering of the hatch cover 42 onto the positioned liner assembly.

Because the bond 64 between any given gripper assembly and the underside of the liner 2 extends primarily over the mounting flange 62 of the gripper assembly the gripper is normally suspended below the hatch liner 2 as shown in FIG. 4 so that the liner 2 is not locally deformed due to the bonding of the gripper assembly along respective inner dimensions which are less than those being employed for the particular hatch size involved. However, this mounting arrangement adequately secures the gripper assembly to the liner 2 so that the outwardly extending section of the liner is illustrated in FIG. 5 to further extend around the inner coaming lip 38 below the hatch gasket 44. In the event that a smaller hatch is being fitted with the universal liner as taught herein, the liner will also conform around and between an outer coaming lip 40, and the respective gasket mating surface of hatch cover gasket 44, to hang outside of the hatch cover 42. In this respect as shown in FIG. 5 the inverted hatch tent may further employ structure such as a batten arrangement at 66 for conveniently draping or securing any oversized liner material when the outer edge 4 of this universal liner is larger than the particular hatch cover being sealed thereby.

Positioning of the inverted hatch cover as taught herein is easily done with ship rigging by engaging a line on the lifting strap 28 and simply raising the apex of the hatch cover upwardly above the level of the hatch coaming lips 38 so that the outer leg 56 will be resiliently urged away from the undersurface 54 as the lifting strap 22 is raised thereabove. Because the gripper inner contour 58 is mutually deformable and curved to facilitate release from the coaming lip 38, the hatch tent may be conveniently removed from the coaming simply by the resultant force urged against the elastomeric outer leg 56 from the central lifting operation. There may further be provided at the respective mid points along the edge of the hatch cover, and/or the corners, further grommets or mounting assemblies for additional lines to be connected to ship rigging to assist in the simple removal of the instant cover. Replacement of a thusly removed hatch cover as taught herein is simply accomplished by lowering the central lifting strap upon a coaming lip with assistance in maintaining the rectangular outer contour of the liner coming from lines attached to the above-mentioned grommet or securing points as illustrated at 68 in FIG. 1.

While there has been shown and described a representative embodiment of the instant invention, we intend our invention to be defined and solely limited by the appended claims.

We claim:

1. An inverted hatch tent operable for protecting a ship's cargo from water damage comprising, in combination:

a. a substantially rectangular flexible liner having a length dimension, a width dimension and an upper and a lower surface; and b. a gripping means extending from said lower liner surface, said gripper means being further defined by a plurality of concentrically arranged substantially rectangular gripping lines; wherein one substantially rectangular gripping line is proximate the length and width dimensions of said liner whereby said upper surface is adapted to assume a concave configuration whenever said liner is supported upon a rectangular hatch coaming that is complementary to, and operably engaged by, one of said plurality of concentrically arranged gripping lines; and c. a water drain means proximate and extending through said liner, said drain means further including a drain line extending from the bottom surface of said liner and communicating with the upper surface of said liner in the vicinity of an apex of said concave configuration; whereby water accumulating on the upper surface of said liner will be drained.

2. An inverted hatch tent according to claim 1, wherein at least one of said rectangular gripping lines further comprises a plurality of spaced elastomeric gripper elements, each element having at least a portion of an upper surface bonded to said lower liner surface and further including an outwardly positioned and downwardly extending leg to define, with the undersurface of said gripper elements, a downwardly open series of gripping cavities along said rectangular gripping line.

3. An inverted hatch tent according to claim 1 wherein said water drain means extends through an apex of said concave configuration which is proximate the geometric center of said liner.

4. An inverted hatch tent according to claim 1, wherein each of said rectangular gripping lines further comprises a plurality of spaced elastomeric gripper elements, each element having at least a portion of an upper surface bonded to said lower liner surface and further including an outwardly positioned and downwardly extending leg to define, with the undersurface of said gripper elements, a downwardly open series of gripping cavities along each of said plurality of rectangular gripping lines.

5. An inverted hatch tent according to claim 4, wherein said substantially rectangular liner further comprises four triangular quadrants of liner material, each quadrant being respectively joined together at its sides along the two diagonals of said rectangular liner with each respective triangular quadrant having its base defining respective length and width dimensions of said rectangular liner.

6. An inverted hatch tent according to claim 1 wherein said substantially rectangular liner further comprises four triangular quadrants of liner material, each quadrant being respectively joined together at its sides along the two diagonals of said rectangular liner with each respective triangular quadrant having its base defining respective length and width dimensions of said rectangular liner.

7. An inverted hatch tent according to claim 6 wherein the apex of each triangular liner quadrant meets at the geometrical center of said liner to define a concave upper surface of at least a portion of said liner when supported, outwardly therefrom, only by said gripping means.

8. An inverted hatch tent in combination with a ship's cargo hatch to protect cargo therein from water damage comprising, in combination:

a. a substantially rectangular flexible liner having a length dimension, a width dimension and an upper and a lower surface; and b. a gripping means extending from said lower liner surface, said gripper means being further defined by a plurality of concentrically arranged substantially rectangular gripping lines, wherein one substantially rectangular gripping line is proximate the length and width dimensions of said liner whereby said upper surface is adapted to assume a concave configuration whenever said liner is supported upon a rectangular hatch coaming that is complementary to, and operably engaged by, one of said plurality of concentrically arranged gripping lines; and c. a water drain means proximate and extending through said liner, said drain means further including a drain line extending from the bottom surface of said liner and communicating with the upper surface of said liner in the vicinity of an apex of said concave configuration; wherein water accumulating on the upper surface of said liner will be drained;

d. said cargo hatch further including a substantially rectangular coaming which further includes thereupon a lip structure operably engaged in surrounding relation by said complementary and substantially rectangular gripping line.

9. An inverted hatch tent according to claim 8 wherein cargo hatch further includes a hatch cover thereupon, said cover having at its lower surface a resilient hatch gasket mounted in surrounding relationship over one of said substantially rectangular gripper lines which is in surrounding relationship to said coaming lip.

10. An inverted hatch tent according to claim 8, wherein at least one of said rectangular gripping lines further comprises a plurality of spaced elastomeric gripper elements, each element having at least a portion of an upper surface bonded to said lower liner surface and further including an outwardly positioned and downwardly extending leg to define, with the undersurface of said gripper elements, a downwardly open series of gripping cavities along said rectangular gripping lines.

11. An inverted hatch tent according to claim 8, wherein each of said rectangular gripping lines further comprises a plurality of spaced elastomeric gripper elements, each element having at least a portion of an upper surface bonded to said lower liner surface and further including an outwardly positioned and downwardly extending leg to define, with the undersurface of said gripper elements, a downwardly open series of gripping cavities along each of said plurality of rectangular gripping lines.

12. An inverted hatch tent according to claim 8 wherein said water drain line extends downwardly along an inner wall of said hatch and into a bilge at the bottom of said hatch.

13. An inverted hatch tent according to claim 12 wherein said water drain means is located at an apex of said concave configuration which is proximate the geometrical center of said liner.

* * * * *